US007134493B2

(12) United States Patent
Runia

(10) Patent No.: US 7,134,493 B2
(45) Date of Patent: Nov. 14, 2006

(54) LOGGING SYSTEM FOR USE IN A WELLBORE

(75) Inventor: Douwe Johannes Runia, Rijswijk (NL)

(73) Assignee: Shell Oil Company, Houston, TX (US)

( * ) Notice: Subject to any disclaimer, the term of this patent is extended or adjusted under 35 U.S.C. 154(b) by 326 days.

(21) Appl. No.: 10/471,157

(22) PCT Filed: Mar. 8, 2002

(86) PCT No.: PCT/EP02/02604

§ 371 (c)(1),
(2), (4) Date: Oct. 29, 2003

(87) PCT Pub. No.: WO02/073003

PCT Pub. Date: Sep. 19, 2002

(65) Prior Publication Data

US 2004/0074639 A1 Apr. 22, 2004

(51) Int. Cl.
*E21B 47/12* (2006.01)

(52) U.S. Cl. ..... 166/254.2; 166/250.01; 175/24; 175/50

(58) Field of Classification Search ..... None
See application file for complete search history.

(56) References Cited

U.S. PATENT DOCUMENTS

| | | | | |
|---|---|---|---|---|
| 2,179,010 | A | 11/1939 | Creighton et al. | 255/72 |
| 2,838,732 | A | 6/1958 | Brown | 324/10 |
| 3,052,838 | A | 9/1962 | Bennett et al. | 324/10 |
| 3,079,793 | A | 3/1963 | Bus et al. | 73/152 |
| 3,112,442 | A | 11/1963 | Bennett | 324/1 |
| 3,577,781 | A | 5/1971 | Lebourg et al. | 73/152 |
| 3,677,081 | A | 7/1972 | Newton et al. | 73/155 |
| 3,700,049 | A | 10/1972 | Tiraspolsky et al. | 175/50 |
| 3,800,871 | A | 4/1974 | Watson | 166/250 |
| 4,034,806 | A | 7/1977 | McGinn et al. | 166/117.5 |
| 4,106,564 | A | 8/1978 | Tausch | 166/117.5 |
| 4,210,081 | A | 7/1980 | Brieger | 73/155 |
| 4,349,072 | A | 9/1982 | Escaron et al. | |
| 4,529,939 | A | 7/1985 | Kuckes | 324/346 |
| 4,570,481 | A | 2/1986 | McLaurin | 73/152 |
| 4,597,440 | A | 7/1986 | Pottier | 166/250 |
| 4,775,009 | A | 10/1988 | Wittrisch et al. | 166/250 |

(Continued)

FOREIGN PATENT DOCUMENTS

| | | |
|---|---|---|
| EP | 0539240 | 4/1993 |

(Continued)

OTHER PUBLICATIONS

International Search Report dated Jul. 15, 2002.

*Primary Examiner*—Zakiya W. Bates

(57) ABSTRACT

A logging system that may be used in a wellbore formed in an earth. A tubular conduit extends from surface into the wellbore and contains a body of wellbore fluid. A logging tool string may be passed from a position within the conduit to a position outside the conduit at a lower end part thereof, and may be suspended by the conduit in the position outside the conduit. A pressure pulse device is arranged within the conduit in a manner that the pressure pulse device is in data communication with the logging tool. The pressure pulse device is capable of generating pressure pulses in the body of wellbore fluid, which pressure pulses represent data communicated by the logging tool string to the pressure pulse device during logging of earth formation by the logging tool string. The system further includes a control system in fluid communication with the body of wellbore fluid and arranged to receive the pressure pulses.

18 Claims, 3 Drawing Sheets

U.S. PATENT DOCUMENTS

| | | | | |
|---|---|---|---|---|
| 4,785,247 | A | 11/1988 | Meador et al. | 324/338 |
| 4,792,757 | A | 12/1988 | Vail, III et al. | 324/303 |
| 4,879,463 | A | 11/1989 | Wraight et al. | 250/270 |
| 4,901,804 | A | 2/1990 | Thometz et al. | 175/40 |
| 4,932,005 | A | 6/1990 | Birdwell | 367/83 |
| 4,953,636 | A | 9/1990 | Mohn | 166/65.1 |
| 4,979,563 | A | 12/1990 | Patel | 166/250 |
| 5,111,880 | A * | 5/1992 | Wittrisch et al. | 166/385 |
| 5,184,682 | A | 2/1993 | Delacour et al. | 166/385 |
| 5,184,692 | A | 2/1993 | Moriarty | 175/50 |
| 5,244,050 | A | 9/1993 | Estes | 175/393 |
| 5,251,708 | A | 10/1993 | Perry et al. | 175/41 |
| 5,265,680 | A | 11/1993 | Withers et al. | 166/380 |
| 5,295,548 | A | 3/1994 | Yuasa et al. | 175/40 |
| 5,353,872 | A | 10/1994 | Wittrisch | 166/250 |
| 5,376,884 | A | 12/1994 | Sezginer | 324/303 |
| 5,433,276 | A | 7/1995 | Martain et al. | 166/384 |
| 5,563,512 | A | 10/1996 | Mumby | 324/339 |
| 5,589,825 | A | 12/1996 | Pomerleau | 340/854.9 |
| 5,636,686 | A | 6/1997 | Wittrisch | 166/66 |
| 5,969,241 | A | 10/1999 | Auzerais | 73/152.16 |
| 6,119,777 | A | 9/2000 | Runia | 166/254.2 |
| 6,181,132 | B1 | 1/2001 | Runia | 324/303 |
| 6,269,891 | B1 | 8/2001 | Runia | 175/40 |
| 6,279,392 | B1 | 8/2001 | Shahin, Jr. et al. | 73/152.52 |
| 6,419,013 | B1 | 7/2002 | Milne et al. | 166/254.2 |
| 6,702,041 | B1 | 3/2004 | Runia | 175/40 |
| 2001/0035289 | A1 | 11/2001 | Runia | 166/66 |

FOREIGN PATENT DOCUMENTS

| | | | |
|---|---|---|---|
| GB | 2196410 | A | 4/1988 |
| RU | 2002945 | | 6/1991 |
| SU | 941557 | B | 5/1980 |
| SU | 962591 | A | 10/1980 |
| SU | 1258992 | A | 3/1985 |
| WO | 96/24748 | | 8/1996 |
| WO | 96/24751 | | 8/1996 |
| WO | 99/45236 | | 10/1999 |

* cited by examiner

LOGGING SYSTEM FOR USE IN A WELLBORE

The present application claims priority on European Patent Application 01302175.3, filed on 9 Mar. 2001.

FIELD OF THE INVENTION

The present invention relates to a logging system for use in a wellbore formed in an earth formation and to a method of logging the earth formation, wherein a tubular conduit containing a body of wellbore fluid extends from surface into the wellbore. The tubular conduit can be, for example, a drill string or a wellbore casing.

BACKGROUND OF THE INVENTION

Logging systems used for logging earth formations include wireline operated logging tools and wireless logging tools. Generally, wireless logging tools are battery powered and are provided with an electronic memory for storing the logging data. After conducting a logging run, the tool is retrieved to surface where the logging data are read out from the electronic memory.

A problem relating to the use of wireless logging tools is that during logging no information is available to the operator with regard to the functioning of the logging tool. For example, in case the logging tool is not correctly deployed in the borehole during the logging operation, the operator will notice the incorrect deployment only during read out of the electronic memory after one or more logging runs have been carried out. In such situation valuable drilling rig time is lost as it may be required to re-run the logging tool in the same wellbore interval. Also, circumstances may prevent rerunning of the logging tool in the same wellbore interval, leading to the absence of useful logging data for the interval.

SUMMARY OF THE INVENTION

In accordance with the invention there is provided a logging system for use in a wellbore formed in an earth formation, comprising a tubular conduit extending from surface into the wellbore and containing a body of wellbore fluid;

a logging tool string capable of passing from a position within the conduit to a position outside the conduit at a lower end part thereof and capable of being suspended by the conduit in said position outside the conduit;

a pressure pulse device arranged within the conduit in a manner that the pressure pulse device is in data communication with the logging tool, the pressure pulse device being capable of generating pressure pulses in the body of wellbore fluid, said pressure pulses representing data communicated by the logging tool string to the pressure pulse device during logging of earth formation by the logging tool string; and a control system in fluid communication with the body of wellbore fluid and being arranged to receive said pressure pulses.

The method according to the invention of logging an earth formation in the vicinity of a wellbore formed in the earth formation whereby a tubular conduit containing a body of wellbore fluid extends from surface into the wellbore, comprises:

a) passing a logging tool string from a position within the conduit to a position outside the conduit at a lower end part thereof and suspending the logging tool string from the conduit in said position outside the conduit;

b) arranging a pressure pulse device in the conduit in a manner that the pressure pulse device is in data communication with the logging tool, the pressure pulse device being capable of generating pressure pulses in the body of wellbore fluid, said pressure pulses representing data communicated by the logging tool string to the pressure pulse device during logging of the logging tool string in the wellbore;

c) arranging a control system in fluid communication with the body of wellbore fluid and in a manner so as to receive said pressure pulses; and d) inducing the logging tool string to log the earth formation and inducing the pressure pulse device to generate pressure pulses in the body of wellbore fluid, said pressure pulses representing data communicated by the logging tool string to the pressure pulse device during logging of the logging tool string.

It is thereby achieved that the pressure pulse device generates pressure pulses in the body of wellbore fluid representative of the logging operation, which pressure pulses are detected by the control system at surface. The operator is thereby in a position to evaluate the functioning of the logging tool string during the logging operation, and to take appropriate measures at an early stage if necessary.

BRIEF DESCRIPTION OF THE DRAWING

The invention will be described hereinafter in more detail and by way of example, with reference to the accompanying drawings in which the examples should not be construed to limit the scope of the invention.

In the Figures like reference numerals relate to like components.

DETAILED DESCRIPTION OF THE PREFERRED EMBODIMENT

Figure 1:
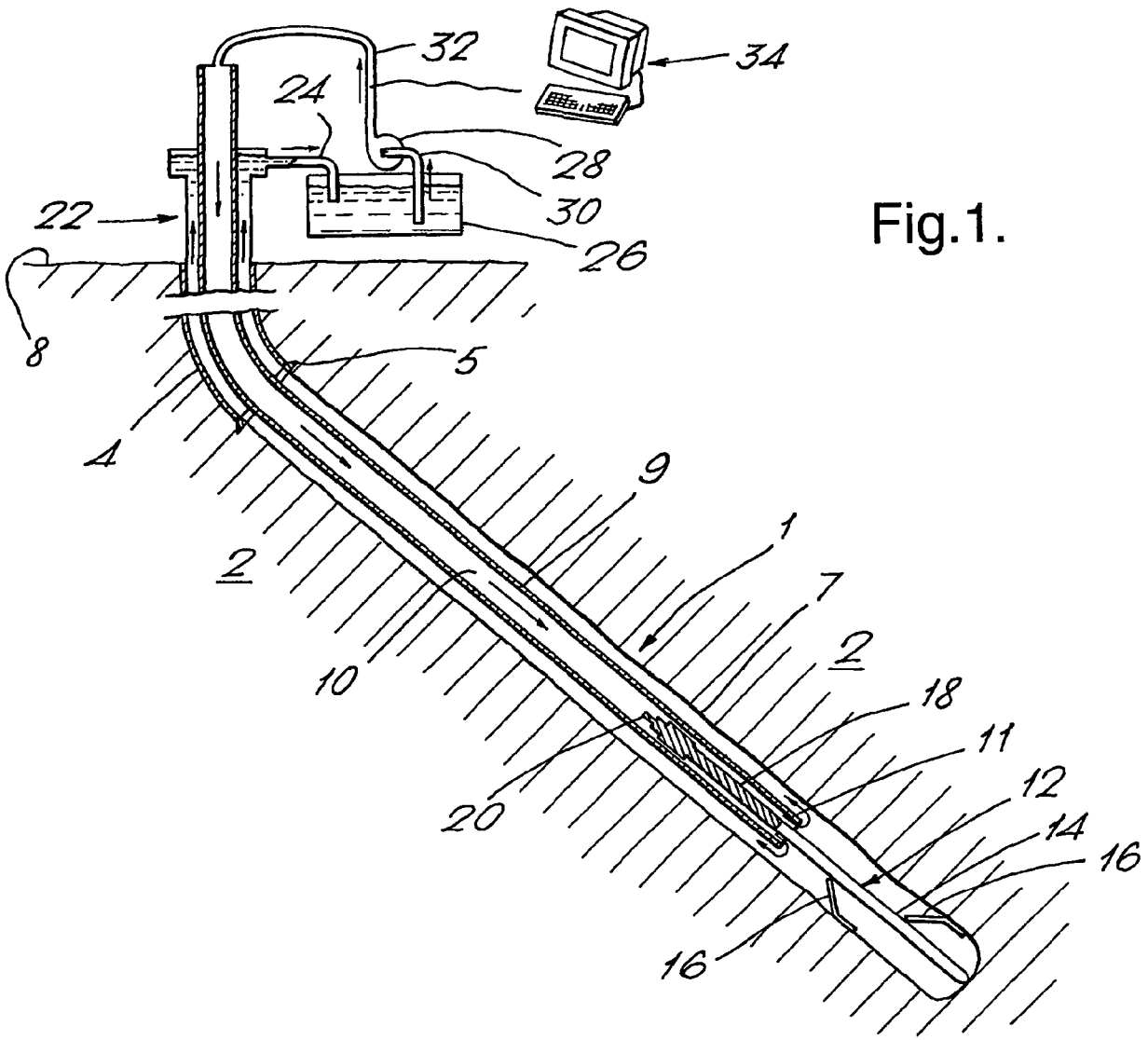
FIG. 1 schematically shows a first embodiment of the logging system of the invention, using a casing extending in the wellbore.

Referring to FIG. 1 there is shown a wellbore 1 formed in an earth formation 2, the wellbore being filled with drilling fluid. The wellbore has an upper portion provided with a casing 4 extending from a drilling rig (not shown) at surface 8 into the wellbore 1 to a casing shoe 5, and an open lower portion 7 extending below the casing shoe 5. A tubular drill string 9 containing a body of drilling fluid 10 and having an open lower end 11 extends from the drilling rig into the wellbore 1 whereby the open lower end 11 is arranged in the open lower wellbore portion 7. A logging tool string 12 capable of being lowered or raised through the drill string 9, is retrievably suspended in the drill string 9 by suitable means (not shown). The string 12 includes a repeat formation tester (RFT) tool 14 having retractable arms 16, and a fluid pressure pulse device 18 arranged at the upper side of the RFT tool 14, whereby the RFT tool 14 extends below the lower end part 11 of the drill string 9 and the pressure pulse device 18 is arranged within the drill string 9. The RFT tool 14 is powered by a battery (not shown) and is provided with an electronic memory (not shown) for storing logging data.

The fluid pressure pulse device 18 has a variable flow restriction (not show) which is controlled by electric signals transmitted by the RFT tool 14 to the pressure pulse device 18, which signals represent part of the logging data produced by the RFT tool 14 during logging of the earth formation 2. The upper end of the logging tool string 12 is provided with a latch 20 for latching of a wireline (not shown) to the string 12.

A wellhead 22 is connected to the upper end of the casing 4 and is provided with an outlet conduit 24 debouching in a drilling fluid reservoir 26 provided with a suitable sieve means (not shown) for removing drill cuttings from the drilling fluid. A pump 28 having an inlet 30 and an outlet 32 is arranged to pump drilling fluid from the fluid reservoir 26 into the upper end of the drill string 9.

A control system 34 located at surface is connected to the drill string 9 for sending or receiving fluid pressure pulses in the body of drilling fluid 10 to or from the fluid pressure pulse device 18.

Figure 2:
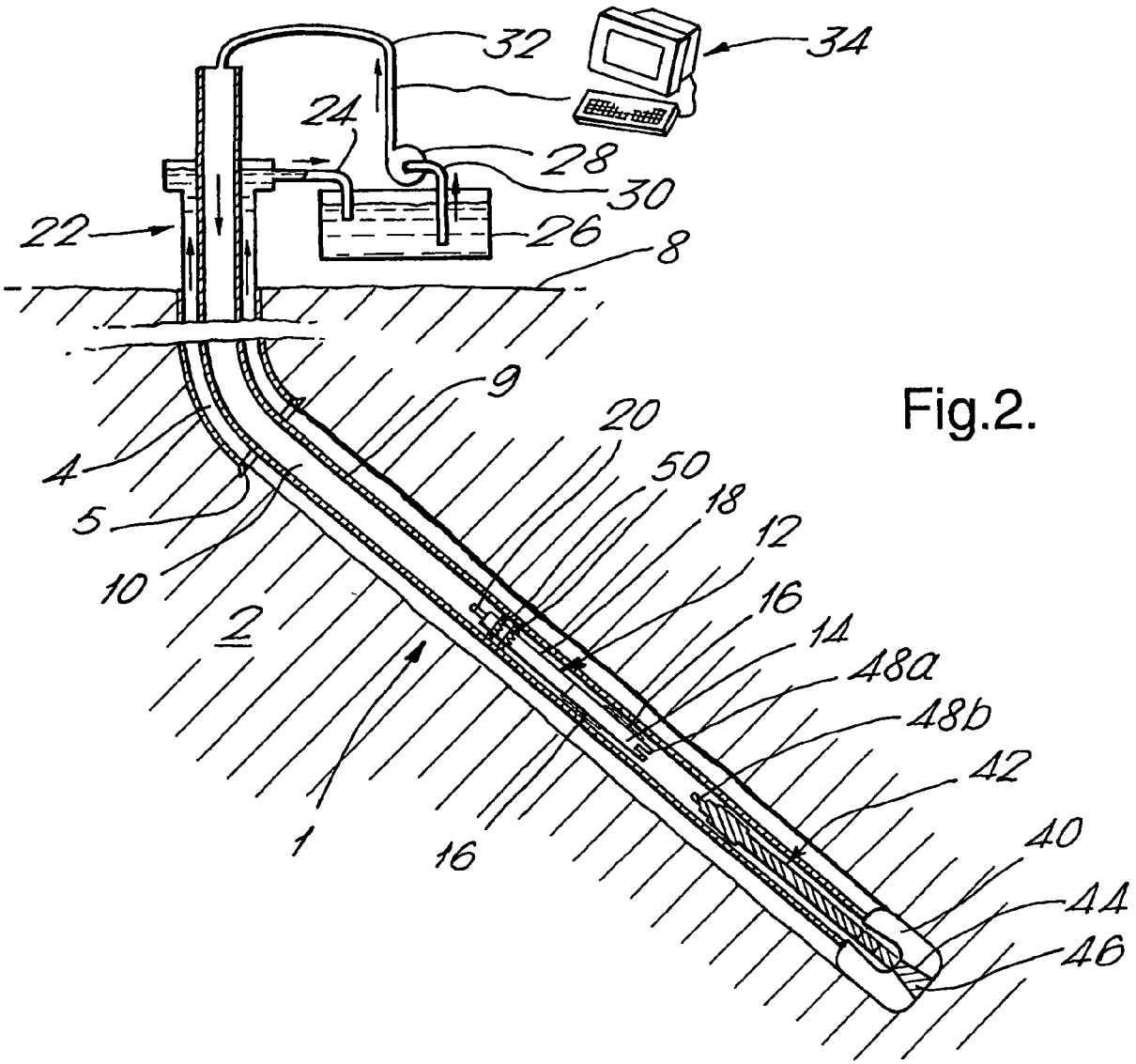
FIG. 2 schematically shows a second embodiment of the logging system of the invention, using a drill string extending in the wellbore.

The second embodiment shown in FIG. 2 is largely similar to the first embodiment, except with respect to the following aspects. The drill string is provided with a drill bit 40 at the lower end thereof, a measurement-while-drilling (MWD) device 42 is removably arranged in the lower end part of the drill string, and the logging tool string 12 is shown as being lowered through the drill string 9. The drill bit 40 is provided with a passage 44 in fluid communication with the interior of the drill string 9, which passage 44 is provided with a closure element 46 removable from the passage 44 in outward direction and connected to the MWD device 42. The lower end of the logging tool string 12 and the upper end of the MWD device 42 are provided with respective cooperating latching members 48*a*, 48*b* capable of latching the logging tool string 12 to the MWD device 42. Furthermore, the logging tool string 12 is provided with pump cups 50 for pumping the logging tool string 12 through the drill string, either in downward or upward direction thereof.

The closure element 46 has a latching mechanism (not shown) for latching the closure element 46 to the drill bit 40. The latching mechanism is arranged to co-operate with the latching members 48*a*, 48*b* in a manner that the closure element 46 unlatches from the drill bit 40 upon latching of latching member 48*a* to latching member 48*b*, and that the closure element 46 latches to the drill bit 40, and thereby closes passage 44, upon unlatching of latching member 48*a* from latching member 48*b*.

Figure 3:
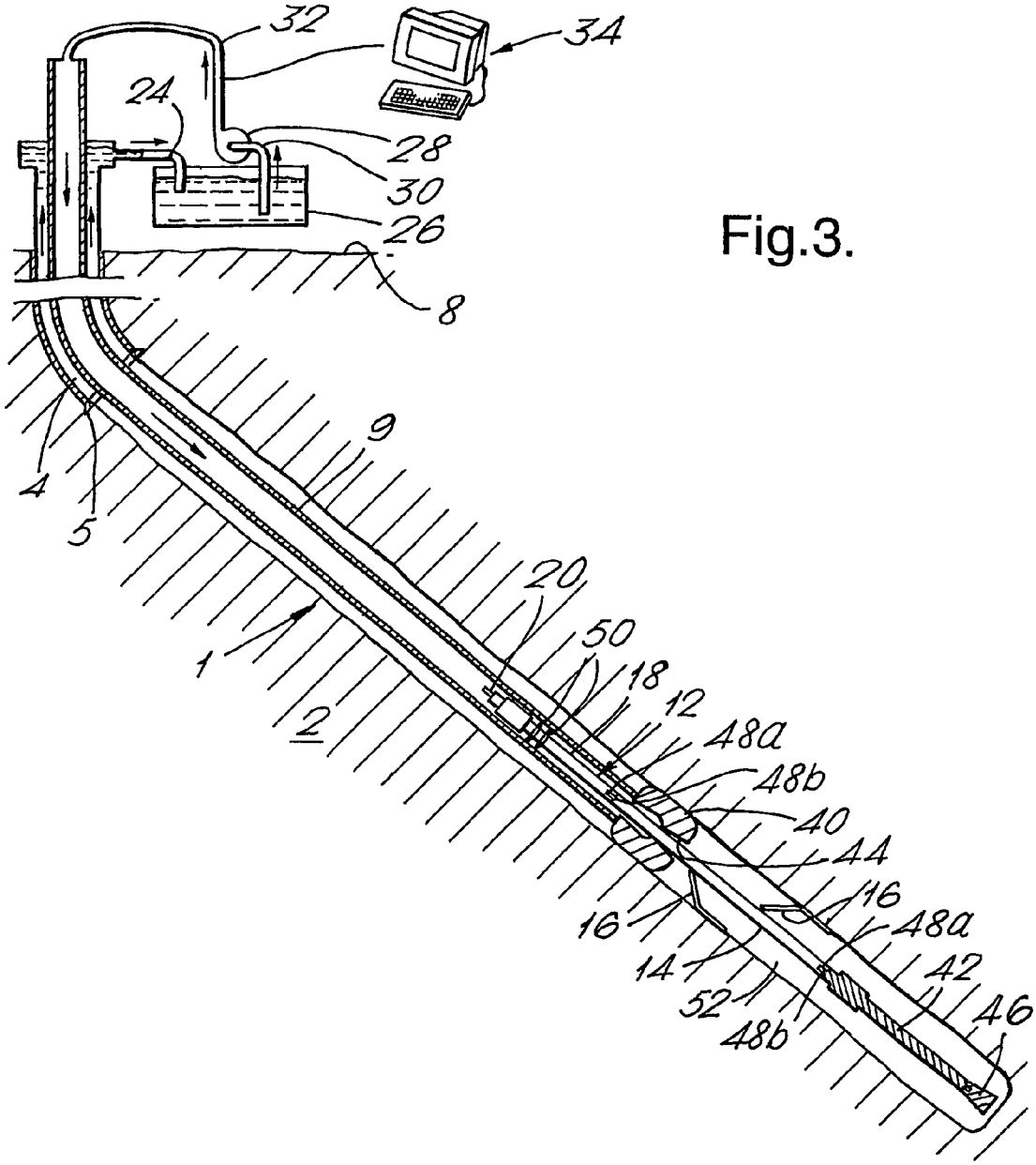
FIG. 3 schematically shows the embodiment of FIG. 2 during a further stage of operation.

In FIG. 3 is shown the embodiment of FIG. 2 during a further stage of operation whereby the logging tool string 12 has been latched to the MWD device 42 and the closure element 46 has been unlatched from the drill bit 40. The drill string 9 has been raised a selected distance in the wellbore 1 so as to leave a space 52 between the drill bit 40 and the wellbore bottom. The logging tool string 12 is suspended by the drill string 9 in a manner that the RFT tool 14 extends through the passage 44 to below the drill bit 40, and that the pressure pulse device 18 is arranged within the drill string 9. The MWD device 42 and the closure element 46 consequently extend below the logging tool string 12.

During normal operation of the embodiment of FIG. 1, the drill string 9 is lowered into the wellbore 1 until the lower end of the string 9 is positioned in the open wellbore portion 7. Next the logging tool string 12 is lowered from surface through the drill string 9 by means of a wireline (not shown) latched to the logging tool string 12 at latch 20, whereby during lowering the arms 16 are retracted. Lowering continues until the RFT tool 14 extends below the drill string 9 while the pressure pulse device 18 is positioned within the drill string 9, in which position the logging tool string 12 is suitably supported. The arms 16 are then extended against the wall of the wellbore and the RFT tool 14 is induced to log the earth formation 2. The logging data are stored in the electronic memory, and part of the logging data are transmitted by the RFT device 14 in the form of electric signals to the pressure pulse device 18, which signals induce controlled variations of the variable flow restriction.

Simultaneously with operating the logging tool string 12, drilling fluid is pumped by pump 28 from the fluid reservoir 26 into the drill string 9 via inlet 30 and outlet 32. The controlled variations of the variable flow restriction induce corresponding pressure pulses in the body of drilling fluid present in the drill string 9, which pressure pulses are monitored by the control system 34. In this manner the operator is in a position to monitor the logging operation and to take corrective action if necessary. For example, incorrect deployment of the arms 16 of the RFT tool can be detected in this manner at an early stage.

After the logging run has been completed, the logging tool string 12 is retrieved through the drill string 9 to surface by wireline connected to latch 20. Optionally the drill string 9 is then removed from the wellbore 1.

During normal operation of the embodiment of FIGS. 2 and 3, the drill string 9 is operated to drill the lower wellbore portion 7 whereby the closure element 46 is latched to the drill bit 40 so as to form a part thereof. The MWD device 42 induces fluid pressure pulses in the body of drilling fluid 10 representative of selected drilling parameters such as wellbore inclination or wellbore temperature. The use of MWD devices is known in the art of drilling, and will not be explained in more detail in this context as it does not form part of the invention.

When it is desired to log the earth formation 2 surrounding the open wellbore portion 7, the logging tool string 12 is pumped down the drill string 9 using pump 28 until the logging tool string 12 latches to the MWD device 42 by means of latching members 48*a*, 48*b*. During lowering of the string 12, the arms 16 of the RFT tool are retracted. Then the drill string 9 is raised a selected distance until there is sufficient space below the drill string for the RFT tool 14, the MWD device 42 and the closure element 46 to extend below the drill bit 40. Upon latching of latching member 48*a* to latching member 48*b*, the closure element 46 unlatches from the drill bit 40. Continuous operation of pump 28 causes further downward movement of the combined logging tool string 12, MWD device 42 and closure element 46 until the logging tool string 12 becomes suspended by the drill string. In this position (shown in FIG. 3) the RFT tool 14 extends through the passage 44 into the space 52 below the drill bit 40, and the pressure pulse device 18 and closure element 46 extend below the RFT tool in said space 52.

The arms 16 are then extended against the wall of the wellbore and the RFT tool 14 is induced to log the earth formation 2. The logging data are stored in the electronic memory, and part of the logging data are transmitted by the RFT device 14 in the form of electric signals to the pressure pulse device 18, which signals induce controlled variations of the variable flow restriction of the MWD device 42.

Simultaneously with operating the logging tool string 12, drilling fluid is pumped by pump 28 from the fluid reservoir 26 into the drill string 9 via inlet 30 and outlet 32. The controlled variations of the variable flow restriction induce corresponding pressure pulses in the body of drilling fluid present in the drill string 9, which pressure pulses are monitored by the control system 34. Thus, the operator is in a position to monitor the logging operation and to take corrective action if necessary (similarly to the embodiment of FIG. 1).

After logging has been completed, the logging tool string 12 is retrieved to surface through the drill string 9 by wireline connected to latch 20. During retrieval the closure element 46 latches to the drill bit 40 (thereby closing the passage 44) and the latching members 48*a*, 48*b* unlatch. Alternatively the logging tool string can be retrieved to surface by reverse pumping of drilling fluid, i.e. pumping of drilling fluid down through the annular space between the drill string 9 and the wellbore wall and into the lower end of the drill string 9. Optionally a further wellbore section then can be drilled, or the drill string 9 can be removed from the wellbore 1.

Instead of lowering the logging tool string from surface through the drill string, the logging tool string can be latched into a lower section of the drill string during lowering of the drill string into the wellbore. At the desired depth the logging tool string is then moved to the exterior of the drill string by, for example, pumping a ball or a dart down the drill string so as to activate the latch release mechanism of the logging tool string.

The invention claimed is:

1. A logging system for use in a wellbore formed in an earth formation, comprising a tubular conduit extending from surface into the wellbore and containing a body of wellbore fluid;

a logging tool string capable of passing from a position within the conduit to a position outside the conduit at a lower end part thereof and capable of being suspended by the conduit in said position outside the conduit;

a pressure pulse device arranged within the conduit in a manner that the pressure pulse device is in data communication with the logging tool, the pressure pulse device being capable of generating pressure pulses in the body of wellbore fluid, said pressure pulses representing data communicated by the logging tool string to the pressure pulse device during logging of earth formation by the logging tool string; and a control system in fluid communication with the body of wellbore fluid and being arranged to receive said pressure pulses.

2. The logging system of claim 1, wherein the logging tool string is capable of passing through the conduit from surface to said position outside the conduit.

3. The logging system of claim 2, wherein the tubular conduit is a drill string for drilling the wellbore, and the logging tool string is suspended by the drill string in a manner that the logging tool string extends below the drill string and in an open part of the wellbore.

4. The logging system of claim 3, wherein the drill string includes a drill bit having a passage for passage there through there through of the logging tool string, and wherein the logging tool string is suspended by the drill string in a manner that part of the logging tool string extends in said passage.

5. The logging system of claim 3, wherein the logging tool string has a lower end part latched to a measurement while drilling device for transmitting fluidic pressure pulses to surface during drilling with the drill string, wherein both the logging tool string and the measurement while drilling device extend outside the conduit at the lower end part thereof.

6. The logging system of claim 2, wherein the logging tool string has a lower end part latched to a measurement while drilling device for transmitting fluidic pressure pulses to surface during drilling with the drill string, wherein both the logging tool string and the measurement while drilling device extend outside the conduit at the lower end part thereof.

7. The logging system of claim 1, comprising means for lowering and/or retrieving the logging tool string through the conduit.

8. The logging system of claim 1, wherein the tubular conduit is one of a wellbore casing and a drill string.

9. The logging system of claim 1, wherein the tubular conduit is a drill string for drilling the wellbore, and the logging tool string is suspended by the drill string in a manner that the logging tool string extends below the drill string and in an open part of the wellbore.

10. The logging system of claim 9, wherein the drill string includes a drill bit having a passage for passage there through there through of the logging tool string, and wherein the logging tool string is suspended by the drill string in a manner that part of the logging tool string extends in said passage.

11. The logging system of claim 10, wherein the logging tool string has a lower end part latched to a measurement while drilling device for transmitting fluidic pressure pulses to surface during drilling with the drill string, wherein both the logging tool string and the measurement while drilling device extend outside the conduit at the lower end part thereof.

12. The logging system of claim 9, wherein the logging tool string has a lower end part latched to a measurement while drilling device for transmitting fluidic pressure pulses to surface during drilling with the drill string, wherein both the logging tool string and the measurement while drilling device extend outside the conduit at the lower end part thereof.

13. A method of logging an earth formation in the vicinity of a wellbore formed in the earth formation, whereby a tubular conduit containing a body of wellbore fluid extends from surface into the wellbore, the method comprising a) passing a logging tool string from a position within the conduit to a position outside the conduit at a lower end part thereof and suspending the logging tool string from the conduit in said position outside the conduit;

b) arranging a pressure pulse device in the conduit in a manner that the pressure pulse device is in data communication with the logging tool, the pressure pulse device being capable of generating pressure pulses in the body of wellbore fluid, said pressure pulses representing data communicated by the logging tool string to the pressure pulse device during logging of the logging tool string in the wellbore;

c) arranging a control system in fluid communication with the body of wellbore fluid and in a manner so as to receive said pressure pulses; and d) inducing the logging tool string to log the earth formation and inducing the pressure pulse device to generate pressure pulses in the body of wellbore fluid, said pressure pulses representing data communicated by the logging tool string to the pressure pulse device during logging of the logging tool string.

14. The method of claim 13, wherein the logging tool string and the pressure pulse device are interconnected, and wherein steps a) and b) are carried out simultaneously.

15. The method of claim 14, wherein the tubular conduit is a drill string and step a) is preceded by drilling a section of the wellbore with the drill string whereby a measurement while drilling device is arranged within the drill string, wherein the logging tool string has a lower end part provided with latching means for latching of the logging tool string to the measurement while drilling device, and wherein step a) includes latching the logging tool string to the measurement while drilling device.

16. The method of claim 15, wherein step a) includes suspending the logging tool string from the conduit in a manner that both the logging tool string and the measurement while drilling device extend outside the conduit at the lower end part thereof.

17. The method of claim 13, wherein the tubular conduit is a drill string and step a) is preceded by drilling a section of the wellbore with the drill string whereby a measurement while drilling device is arranged within the drill string, wherein the logging tool string has a lower end part provided with latching means for latching of the logging tool string to the measurement while drilling device, and wherein step a) includes latching the logging tool string to the measurement while drilling device.

18. The method of claim 17, wherein step a) includes suspending the logging tool string from the conduit in a manner that both the logging tool string and the measurement while drilling device extend outside the conduit at the lower end part thereof.

* * * * *